United States Patent [19]

Dash et al.

[11] Patent Number: 4,773,590

[45] Date of Patent: Sep. 27, 1988

[54] SEPARATED END POST JOINT

[75] Inventors: Wayne D. Dash, Herminie; Robert O. Walter, Meadville; W. Barry Collins, Wexford, all of Pa.

[73] Assignee: TASA Corporation, Pittsburgh, Pa.

[21] Appl. No.: 32,002

[22] Filed: Mar. 30, 1987

[51] Int. Cl.[4] ..... E01B 11/00

[52] U.S. Cl. ..... 238/153

[58] Field of Search ..... 238/151, 152, 159, 218, 238/225, 226, 227, 249, 153

[56] References Cited

U.S. PATENT DOCUMENTS

| | | | |
|---|---|---|---|
| 369,446 | 9/1887 | Georget | 238/225 |
| 735,631 | 8/1903 | Weber | 238/225 |
| 991,488 | 5/1911 | de Remer | 238/218 |
| 993,153 | 5/1911 | Cusick | 238/226 |
| 1,967,509 | 7/1934 | Jackson | 238/243 |
| 2,143,766 | 1/1939 | Dill | 238/218 |
| 2,160,310 | 5/1939 | Johnson et al. | 238/226 |
| 3,100,080 | 8/1963 | Fiechter | 238/151 |
| 3,139,364 | 6/1964 | Fiechter | 238/243 |
| 3,666,175 | 5/1972 | Gill | 238/152 |
| 3,837,948 | 9/1974 | Nelson et al. | 238/243 |
| 3,952,948 | 4/1976 | Nelson et al. | 238/151 |
| 4,292,110 | 9/1981 | Marteness | 238/159 |
| 4,466,570 | 8/1984 | Howard | 238/159 |

*Primary Examiner*—Sherman D. Basinger
*Assistant Examiner*—Jesùs D. Sotelo
*Attorney, Agent, or Firm*—Stanley J. Price, Jr.

[57] ABSTRACT

An apparatus for electrically insulating a pair of adjacent rail sections that form separate electrical signal circuits includes a pair of electrically insulating end posts positioned in a space provided between the adjacent rail sections. A metallic separator is disposed between the pair of electrically insulating end posts. Both the electrically insulating end posts and the metallic separator have a cross sectional configuration substantially the same as the cross sectional configuration of the adjacent rail sections. The adjacent rail sections are mechanically connected by a pair of connecting bars that are electrically insulated from and adhesively bonded to the adjacent rail sections. In another embodiment guard rail sections are insulated from each other by a pair of electrically insulating end posts positioned in a space provided between the individual guard rail sections. A metallic separator is disposed between the pair of electrically insulating end posts positioned in the space provided between the individual guard rail sections. Metallic spacers separate the adjacent rail sections from the adjacent guard rail sections. The adjacent rail sections and the adjacent guard rail sections are mechanically connected by a pair of connecting bars that are each electrically insulated from and adhesively bonded to the adjacent rails sections and adjacent guard rail sections.

11 Claims, 2 Drawing Sheets

SEPARATED END POST JOINT

BACKGROUND OF THE INVENTION

1. Field of the Invention

This invention relates to an apparatus for separating adjacent rail sections, and more particularly, to an apparatus for electrically insulating a pair of adjacent rail sections that form separate electrical signal system circuits.

2. Description of the Prior Art

It is well known in the art of railroad traffic signaling to electrically insulate adjacent rail sections that form separate electrical signal system circuits. Railroad traffic signals are used to indicate when a particular train may proceed along a section of track or when it is required to stop. The presence or absence of a train at a particular location along a track line actuates railroad signals at other locations along the track line to alert railroad traffic personnel of the exact location of the train. Many railroad signal systems pass current through sections of the track so that each section of the track becomes a part of a separate electrical signal system circuit. As a train passes over a particular section of track, the steel wheels and frame of the train short circuit the section of track to provide a signal to display lights positioned along the track line and to a railroad traffic controller operator's panel. After the train passes a particular section of track, the short circuit is removed from the track section.

Since sections of railroad track are utilized to form a part of the railroad traffic signaling system, it is essential that adjacent track sections be electrically insulated from each other to avoid unintended short circuits that could cause an incorrect signal to be produced. To avoid these unintended short circuits between adjacent rail sections, the adjacent rail sections that form separate electrical signal system circuits are insulated from each other by means of an electrically insulated rail joint.

U.S. Pat. No. 3,100,080 discloses an electrically insulated, bonded rail joint for use between adjacent rail sections. An electrically nonconductive, synthetic thermo-setting resin material is disposed between the splice bars and the adjacent rail sections. The synthetic resin material molecularly engages with the surfaces of the adjacent rail sections and the splice bars to prevent longitudinal movement of the adjacent rail sections relative to each other. The bonding material, having electrically insulating properties, electrically insulates the adjacent rail sections from the splice bars to form an electrically insulated joint. The bonding material provides an electrically insulating rail joint which cannot be loosened when subjected to downward forces applied to the rail joint.

U.S. Pat. No. 3,139,364 discloses an electrically insulating, thermo-setting synthetic bonding resin which is interposed between the otherwise contacting surfaces of the various components of a railway track structure. The bonding resin is applied to the contacting surfaces in liquid form. When cured, the bonding resin forms a molecular bond between the contacting surfaces to electrically insulate the components and seal the contacting surfaces against the ingress of foreign bodies, such as abrasive particles, moisture, or other corrosive materials.

U.S. Pat. No. 3,837,948 discloses a method for forming an adhesively bonded rail joint in which the rail mating surfaces of splice bars connecting adjacent rail ends carry a layer of electrically insulating, non-curing, thermoplastic adhesive. Upon application of moderate heat and pressure, the thermoplastic adhesive conforms in shape to the mating surfaces of the rail ends. Because the thermoplastic adhesive does not cure, the joint bars may be removed from the adjacent rail ends by reheating the adhesive. If desired, the noncuring adhesive may be used in conjunction with an electrically nonconductive cloth material to electrically insulate the splice bars from the adjacent rail ends to form an electrically insulated rail joint.

U.S. Pat. No. 4,466,570 discloses an insulated joint for use between sections of rail that are disposed in adjacent signal circuits. The insulating joint includes a separator disposed between a pair of dielectric end posts. Joint bars connecting adjacent sections of rail are notched to accept a portion of the separator head. The insulating fabric disposed between the joint bar and the rail is also notched at the separator head area to allow the separator head to fit securely into the notched portion of the joint bar.

While it has been suggested by the prior art devices to form an electrically nonconductive rail joint by separating metallic surfaces with an electrically insulating resin bonding material, or to utilize an insulated joint that requires specially constructed components including a separator having an enlarged head portion requiring alterations or modifications to the joint bars and insulating fabric, there is a need for an electrically insulated, mechanically connected and adhesive-bonded joint assembly that can be made from standard railroad operating equipment to simplify insulated joint installation and repair. The cross sectional configuration of the metallic separator utilized in the insulated joint assembly should be substantially identical to the cross-sectional configuration of the adjacent rail sections to be insulated. The mechanical connection and adhesive bonding provides an insulated joint having sufficient strength to withstand forces applied to the joint by temperature induced and other longitudinal stresses, in addition to the stresses applied to the joint by the weight of a passing train.

SUMMARY OF THE INVENTION

In accordance with the present invention there is provided apparatus for electrically insulating a pair of adjacent rail sections that form separate electrical signal circuits that includes a pair of adjacent rail sections positioned end to end and separated to provide a space between adjacent rail sections. A plurality of electrically insulating end posts are positioned in the space between adjacent rail sections, and a metallic separator is disposed between each pair of adjacent electrically insulating end posts.

The adjacent rail sections are rigidly connected by a pair of connecting means. The plurality of electrically insulating end posts and the metallic separators are maintained in their respective positions in the space between adjacent rail sections by the pair of connecting means. The connecting means are electrically insulated from and adhesive-bonded to the adjacent rail sections.

Further, in accordance with the present invention there is provided apparatus for electrically insulating a pair of adjacent rail sections at locations where a guard rail is utilized that includes a pair of adjacent rail sections positioned end to end and separated to provide a space between adjacent rail sections. A pair of guard rail sections are positioned end to end and parallel to the adjacent rail sections. The pair of guard rail sections are also separated to provide a space between the guard rail sections.

A plurality of electrically insulating end posts positioned in the space between adjacent rail sections are arranged to extend into the space between guard rail sections. A first metallic separator is disposed between each adjacent pair of electrically insulating end posts and extends into the space between adjacent rail sections. A second metallic separator is disposed between each adjacent pair of electrically insulating end posts and extends into the space between guard rail sections. Spacers are positioned between adjacent first and second metallic separators.

A plurality of spacers are disposed between the adjacent rail sections and the guard rail sections to maintain a preselected distance between the adjacent rail sections and the guard rail sections. Connecting means rigidly connect the adjacent rail sections to the guard rail sections. Connecting means further rigidly connects the adjacent rail sections and the pair of guard rail sections. The connecting means are electrically insulated from and adhesivebonded to the adjacent rail sections and the guard rail sections.

Accordingly, the principal object of the present invention is to provide an apparatus for electrically insulating a pair of adjacent rail sections that form separate electrical signal circuits to prevent short circuits across adjacent rail sections which cause malfunctions in a railroad signal system.

Another object of the present invention is to provide an apparatus for electrically insulating a pair of adjacent rail sections that form separate electrical signal circuits at locations where it is required that a guard rail be utilized in conjunction with an electrically insulating joint positioned between adjacent rail sections.

These and other objects of the present invention will be more completely disclosed and described in the following specification, the accompanying drawings and the appended claims.

DESCRIPTION OF THE PREFERRED EMBODIMENTS

Figure 1:
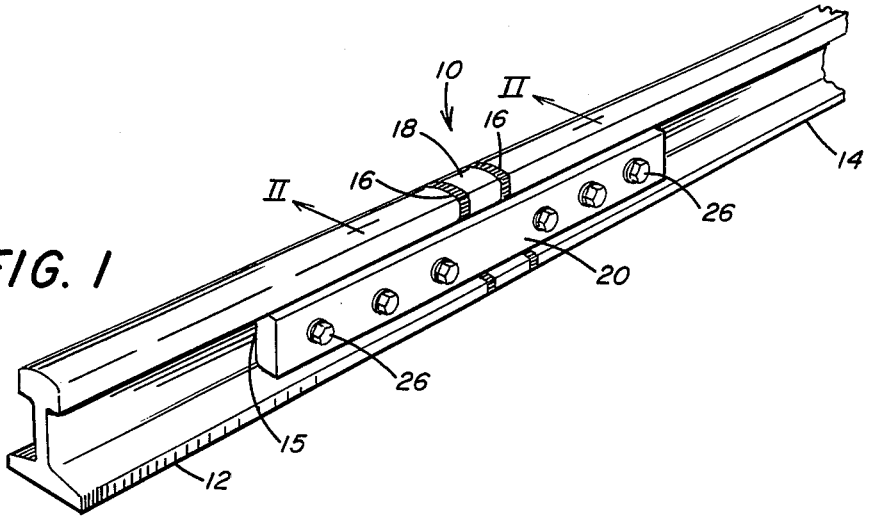
FIG. 1 is a perspective view of a pair of adjacent rail sections and an electrically insulating joint which is the subject of this invention.

Referring to the drawings and particularly to FIG. 1, there is illustrated an insulating apparatus generally designated by the numeral 10 for electrically insulating a pair of adjacent rail sections from each other. Insulating apparatus 10 electrically insulates electrical signals present on adjacent rail sections to ensure proper railroad signal system operation. Insulating apparatus 10 eliminates the problems assocuiated with short circuited adjacent rail sections and the resultant signal system errors.

FIG. 1 illustrates the insulating apparatus generally designated by the numeral 10 positioned between rail section 12 and rail section 14 to electrically insulate electrical signals present on rail section 12 from electrical signals present on rail section 14. Insulating apparatus 10 includes connecting bar 20 and connecting bar 21 (shown in FIG. 3) that mechanically connect rail section 12 to rail section 14. Connecting bars 20 and 21 are commonly referred to in the railroad industry as splice bars or joint bars. As will be explained later in greater detail, connecting bars 20 and 21 are full contact joint bars each having a rail mating surface matching the rail mating surfaces of rail sections 12 and 14. Electrically insulating mesh 15 extends partially around connecting bar 20 to electrically insulate connecting bar 20 from rail section 12 and rail section 14. Similarly, electrically insulating mesh 15 extends partially around connecting bar 21 to electrically insulate connecting bar 21 from rail section 12 and rail section 14. A plurality of bolts 26 rigidly connect connecting bar 20 and connecting bar 21 to rail section 12 and rail section 14. Connecting bars 20 and 21 provide a mechanical connection between rail section 12 and rail section 14.

As seen in FIG. 1, insulating apparatus 10 also includes a pair of electrically insulating end posts 16 and metallic separator 18. Electrically insulating end posts 16 are made from a suitable electrically insulating material, such as a polyurethane or fiberglass material. Metallic separator 18, which separates the pair of electrically insulating end posts 16 from each other, is made from the same type of rail as rail section 12 and rail section 14.

Although insulating apparatus 10 illustrated in FIG. 1 includes two insulating end posts 16 and a single metallic separator 18, it should be understood that insulating apparatus 10 may, if desired, include more than two insulating end posts 16 and a single metallic separator 18. For example, three insulating end posts 16 may be positioned between rail sections 12 and 14. If three insulating end posts 16 are positioned between rail sections 12 and 14, it is understood that a metallic separator 18 should be positioned between each adjacent pair of insulating end posts 16. As described, any number of insulating end posts 16 may be utilized having a metallic separator 18 disposed between each adjacent pair of insulating end posts 16.

Figure 2:
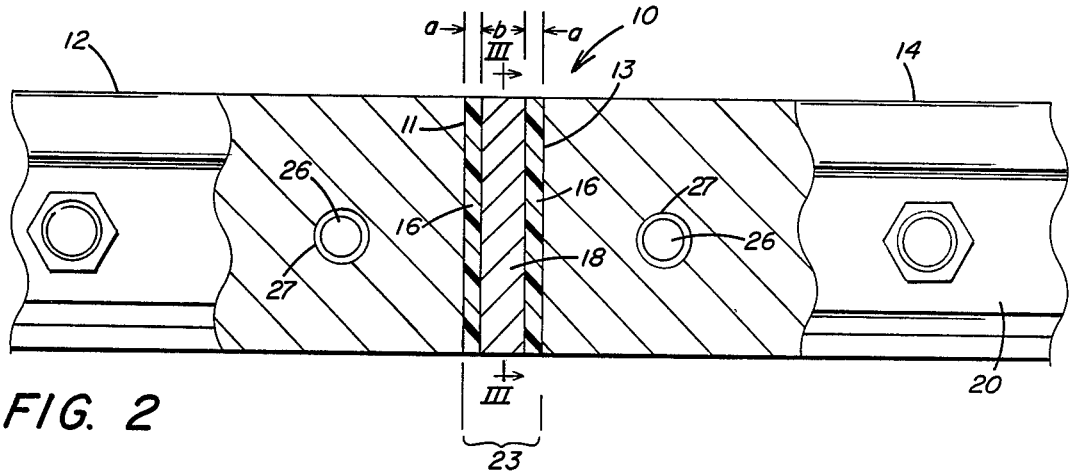
FIG. 2 is a cross sectional view taken along line 2—2 in FIG. 1 extending through the axis of symmetry of the pair of adjacent rail sections.

Insulating apparatus 10 is further illustrated in FIG. 2. Insulating apparatus 10 is designed to completely fill the space designated by the numeral 23 between rail section 12 and rail section 14. The width of space 23 provided between rail section 12 and rail section 14 is determined by the widths a of electrically insulating end posts 16 and the width b of metallic separator 18. The width of space 23 between rail sections 12 and 14 is set by railroad personnel to accomodate both electrically insulating end posts 16 and metallic separator 18. The widths a of the electrically insulating end posts 16 and the width b of the metallic separator 18 are selectively chosen to provide both complete electrical insulation between rail sections 12 and 14 and a satisfactory mechanical joint that can withstand the weight of a passing train.

The pair of electrically insulating end posts 16 are positioned in space 23 so that one end post 16 is in facing relation with surface 11 of rail section 12. Similarly, the second end post 16 is positioned in space 23 in facing relation with surface 13 of rail section 14. The pair of electrically insulating end posts 16 contact surfaces 11 and 13, respectively. As previously described, metallic separator 18 is made from a section of rail identical to rail section 12 and rail section 14. As seen in FIG. 2, even though metallic separator 18 is made from an electrically conductive material, end posts 16 electrically insulate metallic separator 18 from both rail section 12 and rail section 14.

A plurality of bolts 26 rigidly connect connecting bars 20 and 21 to rail section 12 and rail section 14. The plurality of bolts 26 that pass through rail section 12 and rail section 14 are electrically insulated from rail sections 12 and 14 by insulating bushings 27. Bushings 27 are made from a fiberglass or other suitable electrically insulating material. Bushings 27 are designed to pass completely through the bolt holes (not shown) in rail sections 12 and 14 to prevent bolts 26 from contacting rail sections 12 and 14.

As seen in FIGS. 1 and 2, insulating apparatus 10 increases the distance between rail sections 12 and 14 to substantially reduce the possibility of short circuits between rail sections 12 and 14 caused by the accumulation of electrically conductive material between rail sections 12 and 14.

Figure 3:
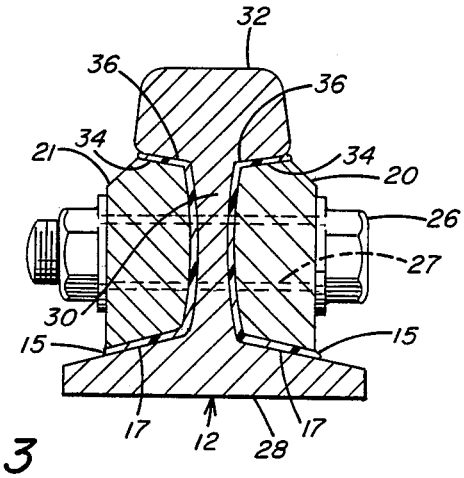
FIG. 3 is a cross sectional view taken along line 3—3 in FIG. 2.

Referring to FIGS. 1 and 3, it is seen that the cross sectional configuration of electrically insulating end posts 16 substantially conforms to the cross sectional configuration of rail section 12 and rail section 14. Similarly, the cross sectional configuration of metallic separator 18 substantially conforms to the cross sectional configuration of rail section 12 and rail section 14. Both rail sections 12 and 14 are representative of standard rail sections used throughout the railroad industry. Since the cross sectional configurations of electrically insulating end posts 16 and metallic separator 18 substantially conform to the cross sectional configuration of rail sections 12 and 14, commercially available full contact joint bars or connecting bars such as connecting bars 20 and 21 may be used to connect rail section 12 and rail section 14. As will be explained later in greater detail, connecting bars 20 and 21 are of the full contacting type to maximize the effective adhesive or bond line between the rail mating surfaces of connecting bars 20 and 21 and the separated rail sections 12 and 14. Further, no modifications or alterations to connecting bars 20 and 21 are required, with the exception of providing bolt holes at preselected locations in connecting bars 20 and 21 to accomodate insulating apparatus 10.

FIG. 3 illustrates connecting bars 20 and 21 rigidly connected to rail section 12 by means of bolts 26 (one shown). Electrically insulating mesh 15 extends partially around connecting bars 20 and 21 respectively to electrically insulate connecting bars 20 and 21 from the rail base 28, upstanding web 30 and rail head 32 of rail section 12. Electrically insulating mesh 15 may consist of any suitable electrically insulating material capable of being formed around connecting bars 20 and 21 as shown.

A suitable layer of adhesive bonding material 17 is applied to insulating mesh 15 between insulating mesh 15 and the rail base 28, upstanding web 30 and rail head 32 of rail section 12 and rail section 14 (not shown). Adhesive bonding material 17 may consist of a thermosetting synthetic bonding material or other suitable bonding agent. Bonding material 17 effectively seals any voids or gaps between connecting bars 20 and 21 and rail sections 12 and 14 to prevent the ingress of foreign bodies, such as abrasive particles, moisture, or other corrosive materials between connecting bars 20 and 21, and rail sections 12 and 14.

More importantly, adhesive bonding material 17, which is electrically nonconductive, molecularly engages with the rail mating surfaces of connecting bars 20 and 21, and rail sections 12 and 14 to provide an adhesive-bonded connection between connecting bars 20 and 21 and rail sections 12 and 14. This adhesive-bonded connection provides an insulating apparatus 10 in which rail sections 12 and 14d are electrically insulated from each other and securely held against longitudinal movement relative to each other. Although not illustrated in FIG. 3, it should be understood that insulating mesh 15 and adhesive bonding material 17 are applied over the full mating surfaces of connecting bars 20 and 21 to provide a continuous electrically insulated, adhesive-bonded connection between connecting bars 20 and 21 and rail sections 12 and 14.

As previously described and illustrated in the Figures, connecting bars 20 and 21 are full contact connecting bars. As such, the rail mating surfaces of connecting bars 20 and 21 conform to the contour of rail base 28, upstanding web 30 and rail head 32 of rail sections 12 and 14, respectively. The layers of adhesive bonding material 17 applied between rail base 28, upstanding web 30 and rail head 32 of rail sections 12 and 14, respectively, and the rail mating surfaces of connecting bars 20 and 21 provide the principal connection between rail sections 12 and 14, and connecting bars 20 and 21. Although connecting bars 20 and 21 provide a mechanical connection between rail sections 12 and 14 by means of the plurality of bolts 26, adhesive bonding material 17 provides the principal connection between connecting bars 20 and 21 and rail sections 12 and 14 to maintain the insulated joint 10 in fixed position. Further, adhesive bonding material 17 provides an insulated joint 10 having sufficient strength to withstand forces applied to the joint by temperature induced and other longitudinal stresses.

As seen in FIG. 3, top surfaces 34 of connecting bars 20 and 21 are in abutting relation to rail head 32 undersurfaces 36. Top surfaces 34 of connecting bars 20 and 21 are maintained in their respective positions with respect to undersurfaces 36 by the plurality of bolts 26 which rigidly connect connecting bars 20 and 21 to rail sections 12 and 14 and primarily by adhesive bonding material 17. Similarly, the under surfaces (not shown) of metallic separator 18 and electrically insulating end posts 16 are also maintained in abutting relation with top surfaces 34 of connecting bars 20 and 21.

As a train passes over metallic separator 18 and electrically insulating end posts 16, the weight of the train will act to force metallic separator 18 and electrically insulating end posts 16 in a downward direction. However, adhesive bonding material 17 provides an adhesive bonded connection between the rail mating surfaces of connecting bars 20 and 21 and rail sections 12 and 14 of sufficient strength to prevent metallic separator 18 and electrically insulating end posts 16 from being forced in a downward direction. Although the close-fitting relationship between the undersurfaces of metallic separator 18, electrically insulating end posts 16, and the abutting top surfaces 34 of connecting bars 20 and 21 participate in maintaining metallic separator 18 and electrically insulating end posts 16 in their respective positions, adhesive bonding material 17 provides the principal connection which maintains metallic separator 18 and end posts 16 in their respective positions as a train passes over insulating apparatus 10.

Figure 4:
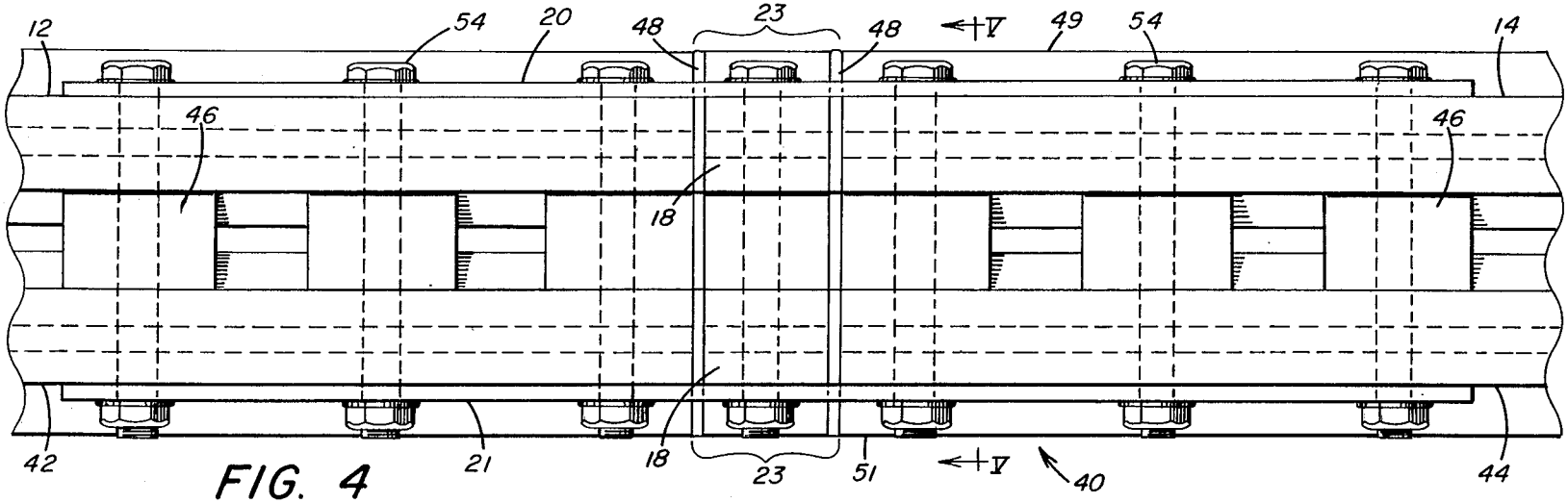
FIG. 4 is a top plan view of a guard rail assembly used in conjunction with a pair of adjacent rail sections and an electrically insulating joint which is the subject of this invention.

Another embodiment of the present invention is illustrated in FIG. 4 for use at locations where it is desired to utilize a guard rail section. Guard rails are employed at certain locations such as severe curves, crossovers and switches. The guard rail is positioned inside the main track to ensure that the flange of the train wheel remains properly positioned with respect to the head portion of the rail.

Referring to FIG. 4, there is illustrated the rail sections 12 and 14 previously described. A guard rail generally designated by the numeral 40 is positioned parallel to rail sections 12 and 14. Guard rail 40 is spaced from rail sections 12 and 14 a preselected minimum distance to allow clearance for the flange of a train wheel which passes between rail sections 12 and 14 and guard rail 40.

The guard rail generally designated by the numeral 40 includes a pair of guard rail sections 42 and 44. As illustrated in FIG. 4, both guard rail sections 42 and 44 are made from the same rail material as rail sections 12 and 14. However, if desired, guard rail sections 42 and 44 may have different rail chemistries or different heat treating properties than rail sections 12 and 14. Also, guard rail sections 42 and 44 may be larger rail sections than rail sections 12 and 14. A plurality of spacers 46 separate guard rail sections 42 and 44 from rail sections 12 and 14.

As seen in FIG. 4, guard rail section 42 is separated from guard rail section 44 by a space designated by the numeral 23. As previously described, rail section 12 is separated from rail section 14 by a space also designated by the numeral 23. A pair of electrically insulating end posts 48 are suitably positioned to extend from space 23 between rail sections 12 and 14 into space 23 between guard rail sections 42 and 44.

Figure 6:
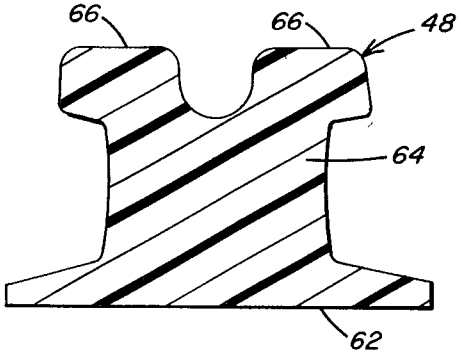
FIG. 6 is a plan view of an electrically insulating end post used in conjunction with a pair of adjacent rail sections and a guard rail assembly.

Electrically insulating end post 48 is further illustrated in FIG. 6. Electrically insulating end post 48 is made from a suitable electrical insulating material, such as a polyurethane or fiberglass material. End post 48 includes a base 62 which, when positioned in the space 23 between rail sections 12 and 14 and guard rail sections 42 and 44, extends from rail section 12 and 14 edge surface 49 to guard rail section 42 and 44 edge surface 51, as illustrated in FIG. 4. End post 48 further includes a generally planar surface 64 and a pair of top surface portions 66, each generally conforming to the cross sectional configuration of the pair of metallic separators 18 rail heads. As shown in FIG. 4, the pair of end posts 48 positioned in the spaces 23 between rail sections 12 and 14 and guard rail sections 42 and 44 electrically insulate rail section 12 from rail section 14, and also electrically insulate guard rail section 42 from guard rail section 44.

The pair of end posts 48 are separated by a pair of metallic separators 18. As previously described, metallic separators 18 are cut from a rail section substantially identical to rail sections 12 and 14. Although separators 18 are made from an electrically conductive material, electrically insulating end posts 48 effectively insulate separators 18 from rail sections 12 and 14, and from guard rail sections 42 and 44. The pair of separators 18 have a spacer 46 therebetween to maintain the separators in position and in spaced relation to each other. Bolt 54 maintains the separators 18 connected to the spacer 46.

Although FIG. 4 illustrates two insulating end posts 48 separated by two metallic insulators 18, it should be understood that, if desired, more than two end posts 48 may be utilized. For example, three insulating end posts 48 may be positioned between adjacent rail sections 12, 14 and guard rail sections 42, 44. If more than two insulating end posts 48 are utilized, a pair of metallic separators 18 are disposed between adjacent pair of end posts 48.

Figure 5:
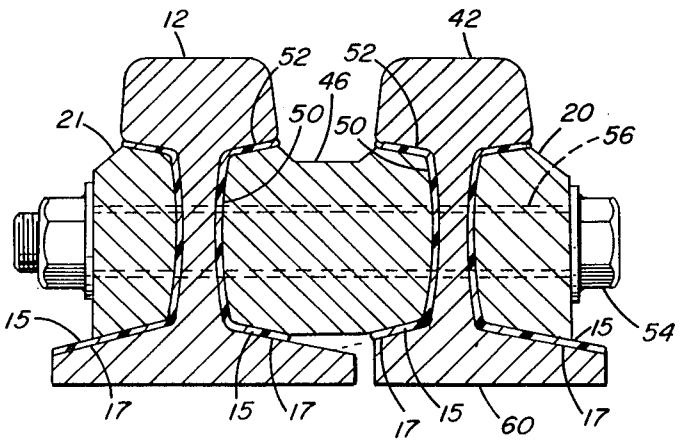
FIG. 5 is a cross sectional view taken along line 5—5 in FIG. 4.

Referring to FIG. 4 and 5, rail sections 12 and 14 are separated from guard rail sections 42 and 44 by a plurality of spacers 46. FIG. 5 illustrates rail section 12 separated from guard rail section 42 by spacers 46 (one shown). Side walls 50 of spacers 46 are made to substantially conform to the contour of inside surfaces 52 of rail section 12 and 14 and guard rail section 42 and 44. If desired, the side walls 50 of spacers 46 may be wrapped with insulating mesh 15 and coated with bonding material 17 to electrically insulate spacers 46 from rail sections 12 and 14, and guard rail sections 42 and 44. As seen in FIG. 5, a portion of guard rail base 60 is removed from guard rail section 42 and guard rail section 44 to allow the inside surfaces 52 of guard rail sections 42 and 44 to contact the side walls 50 of spacers 46.

Connecting bars 20 and 21 are rigidly connected to rail sections 12 and 14 and guard rail sections 42 and 44 by a plurality of bolts 54 (one shown). The plurality of bolts 54 are electrically insulated from the rail sections 12 and 14 and the guard rail sections 42 and 44 by insulating bushings 56. Insulating bushings 56 are made from an electrically insulating material such as fiberglass or other suitable electrically insulating material. Connecting bars 20 and 21 are partially wrapped with a suitable amount of electrically insulating mesh 15 and coated with adhesive bonding material 17 to form an electrically insulated, adhesively bonded joint between connecting bars 20 and 21, rail sections 12 and 14, and guard rail sections 42 and 44.

As earlier described, adhesive bonding material 17 forms an adhesively bonded joint between connecting bars 20 and 21 and the respective rail sections and guard rail sections and provides the principle connection between connecting bars 20 and 21 and the respective rail sections and guard rail sections. Adhesive bonding material 17 forms adhesively bonded connections of sufficient strength to withstand the forces exerted on the insulated joint by a passing train.

As seen in FIG. 4, rail sections 12 and 14 are separated from guard rail sections 42 and 44 by a plurality of spacers 46. Although not specifically illustrated in FIG. 4, the plurality of spacers 46 may be replaced by a single, solid spacer block positioned between rail sections 12 and 14 and guard rail sections 42 and 44 having generally the same overall length as the length of connecting bars 20 and 21. If it is desired to use a single, solid spacer block rather than the plurality of individual spacers 46, then two end posts 70 such as illustrated in FIG. 7 are positioned in the spaces 23 between rail sections 12 and 14 and guard rail sections 42 and 44.

Since a single, solid spacer block would, if used, pass completely through the double rail insulated joint, end posts 70 must each have a configuration to allow the solid spacer block to pass through the insulated joint.

Figure 7:
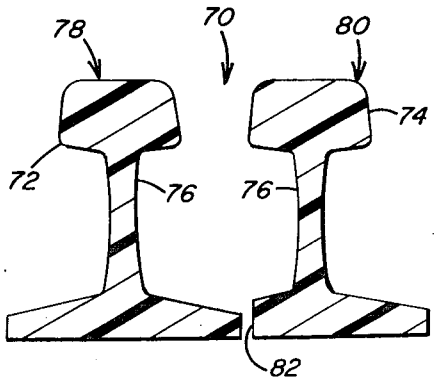
FIG. 7 is a plan view of another electrically insulating end post used in conjunction with a pair of adjacent rail sections and a guard rail assembly.

Electrically insulating end post 70 illustrated in FIG. 7 is made from a suitable electrical insulating material, such as a polyurethane or fiberglass material. As seen in FIG. 7, each end post 70 includes an end post section 78 and an end post section 80. End post section 80 includes a truncated base portion 82 to allow the inside surface 76 of end post section 80 to contact the adjacent side wall of the solid spacer block. End post 70 section 78 includes an insulating portion 72 that substantially conforms to the cross sectional configuration of rail sections 12 and 14; and an end post 70 section 80 insulating portion 74 that substantially conforms to the cross-sectional configuration of guard rail sections 42 and 44. The inside surfaces 76 of end post sections 78 and 80 substantially conform to the contour of the solid spacer block side walls to allow the solid spacer block to pass through end posts 70.

If it is desired to use a solid spacer block rather than the plurality of spacers 46, the spacer block sidewalls must be electrically insulated from rail sections 12 and 14 and the guard rail sections 42 and 44 to prevent current flow between rail sections 12 and 14 and guard rail sections 42 and 44 through the spacer block.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

I claim:

1. An apparatus for electrically insulating a pair of adjacent rail sections from each other comprising, a pair of adjacent rail sections positioned in end to end relation, said adjacent rail sections being separated to provide a space between said adjacent rail sections, a plurality of electrically insulating end post means positioned in said space between said adjacent rail sections, said electrically insulating end post means having substantially the same cross-sectional configuration as said rail sections, metallic separator means disposed between said electrically insulating end post means, said metallic separator means having substantially the same cross-sectional configuration as said rail sections, joint bars rigidly connecting said adjacent rail sections with said electrically insulating end post means and said metallic separator means in said space between said adjacent rail sections, means for electrically insulating said joint bars from said adjacent rail sections, and bonding means for permanently bonding said joint bars to said adjacent rail sections.

2. An apparatus for electrically insulating a pair of adjacent rail sections from each other as set forth in claim 1 in which, said metallic separator means consists of a metallic rail section having the configuration of a portion of one of said adjacent rail sections.

3. An apparatus for electrically insulating a pair of adjacent rail sections from each other as set forth in claim 1 in which, each of said electrically insulating end post means has a preselected width and thickness.

4. An apparatus for electrically insulating a pair of adjacent running rail sections from each other comprising, a pair of adjacent running rail sections positioned in end to end relation, said adjacent rail sections being separated to provide a space between said adjacent rail sections, a pair of adjacent guard rail sections positioned in end to end relation, said pair of guard rail sections positioned parallel to said pair of adjacent running rail sections, said adjacent guard rail sections being separated to provide a space between said adjacent guard rail sections, a plurality of electrically insulating end post means positioned in said space between said adjacent running rail sections, said plurality of electrically insulating end post means arranged to extend into said space between said guard rail sections, first metallic separator means disposed between said electrically insulating end post means, said first metallic separator means arranged to extend into said space between said adjacent running rail sections, said metallic separator means having substantially the same cross-sectional configuration as said running rail sections, second metallic separator means disposed between said electrically insulating end post means, said second metallic separator means arranged to extend into said space between said adjacent guard rail sections, a plurality of spacer means disposed between said guard rail sections and said adjacent running rail sections, joint bars rigidly connecting said adjacent guard rail sections and said adjacent running rail sections, means for electrically insulating said joint bars from said adjacent running rail sections and said adjacent guard rail sections, and bonding means for permanently bonding said connecting means to said guard rail sections and said adjacent running rail sections.

5. An apparatus for electrically insulating a pair of adjacent running rail sections from each other as set forth in claim 4 in which, said guard rail sections are separated a preselected distance from said adjacent running rail sections by said plurality of spacer means, said spacer means secured to said joint bars connecting said adjacent running rail sections and said adjacent guard rail sections.

6. An apparatus for electrically insulating a pair of adjacent running rail sections from each other as set forth in claim 4 in which, said guard rail sections have substantially the same cross sectional configuration as said adjacent running rail sections.

7. An apparatus for electrically insulating a pair of adjacent rail sections from each other as set forth in claim 4 in which, said first metallic separator means includes a first individual metallic separator block, the cross sectional configuration of said first metallic separator block being substantially the same as the cross sectional configuration of said adjacent rail sections, and said second metallic separator means includes a second individual metallic separator block, the cross sectional configuration of said second metallic separator block being substantially the same as the cross sectional configuration of said adjacent guard rail sections.

8. An apparatus for electrically insulating a pair of adjacent rail sections from each other as set forth in claim 7 in which, said first and second metallic separator blocks are separated from each other by one of said plurality of spacer means.

9. An apparatus for electrically insulating a pair of adjacent rail sections from each other as set forth in claim 7 in which, said metallic separator blocks are rigidly connected to said joint bars through one of said adjacent rail sections and one of said adjacent guard rail sections.

10. An apparatus for electrically insulating a pair of adjacent rail sections from each other as set forth in claim 7 which includes, aligned bolt apertures extending through said spacer means said adjacent rail sections, said adjacent guard rail sections and said joint bars, bolt means extending through said bolt apertures to connect said adjacent rail end sections and said adjacent guard rail sections.

11. Apparatus for electrically insulating a pair of adjacent rail end sections from each other as set forth in claim 4, in which aligned bolt apertures extending through said spacer means, metallic separator blocks and said joint bars, bolt means extending through said apertures to connect said joint bars to said metallic separator means and said spacer means.

* * * * *